United States Patent [19]

Hönig

[11] 4,102,771

[45] Jul. 25, 1978

[54] MEASURING DEVICE AND PROCESS FOR RECORDING ON ELECTRODEPOSITION PARAMETERS OF THROWING POWER

[75] Inventor: Helmut Hönig, Graz, Austria

[73] Assignee: Vianova Kunstharz, A.G., Vienna, Austria

[21] Appl. No.: 624,982

[22] Filed: Oct. 22, 1975

[30] Foreign Application Priority Data

Oct. 28, 1974 [AT] Austria ..... 8660/74

[51] Int. Cl.[2] ..... C25D 13/00; C25D 13/22

[52] U.S. Cl. ..... 204/299 EC; 204/181 C; 324/29

[58] Field of Search ..... 204/181, 299, 300; 324/29

[56] References Cited

U.S. PATENT DOCUMENTS

| | | | |
|---|---|---|---|
| 3,502,563 | 3/1970 | Schmidt | 204/300 X |
| 3,627,661 | 12/1971 | Gordon et al. | 204/181 |
| 3,707,446 | 12/1972 | Oyabu et al. | 204/181 X |
| 3,935,085 | 1/1976 | Baker, Jr. et al. | 204/181 |

OTHER PUBLICATIONS

Yeates, "Electropainting," Draper, Ltd. (1966), pp. 41–46.

*Primary Examiner*—Arthur C. Prescott
*Attorney, Agent, or Firm*—A. W. Breiner

[57] ABSTRACT

A method and arrangement for measuring and recording parameters relative to the onset of coagulation and the build-up of film resistance within an electrodeposition bath system. A rapid voltage rise across the bath system is detected by the arrangement, the rapid rise indicating the onset of coagulation, and the parameters are recorded. Parameters are further recorded by the arrangement during the period of build-up of film resistance.

10 Claims, 4 Drawing Figures

MEASURING DEVICE AND PROCESS FOR RECORDING ON ELECTRODEPOSITION PARAMETERS OF THROWING POWER

The process of the electrodeposition (ED) coating has long been known and has been applied on a large scale in industry for some years. An essential property of the ED paint consists in its more or less pronounced capability of flawlessly coating even shielded parts of a workpiece. This property is generally termed "throwing power."

As is known, the anodic deposition of an ED paint proceeds in such manner that a current through the paint from cathode to anode generates an acid boundary layer immediately at the anode; in other words, the pH value is lowered at the anode. If a certain pH value between about 1 and 3 depending on the binder is exceeded downward, the binder will coagulate. In the form of its aqueous solution, i.e., as ED paint, the binder's pH values will be between 6 and 9, but when the binder coagulates, it will start to coat the anode with a well-adhering film, whereby an increase of electrical resistance will occur.

It is known that the throwing power depends, among other things, on relatively easily measured values, for instance, (electrical) conductivity of the ED bath and deposition equivalent of the binder used.

In order to compute or predict a binder's throwing power, however, these parameters will not suffice. It has been found that further parameters are required, namely, the onset of coagulation, that is, the time between the application of current and the initial formation of an adhering film to the substrate, and also the time required to form a wet-film resistance.

However, until now these parameters have not been used in the determination of throwing power because they have not been readily measurable. It is the arrangement of the invention which for the first time allows one to actually measure and record the two parameters, and this is accomplished independently of the kind of binder and of its other specifications.

As already mentioned, the formation of a boundary layer of low pH value is the cause of the coagulation and hence of the film build-up. The rate of formation of the required acid boundary layer for coagulation, that is, reaching the coagulation pH value, primarily depends on current density.

The following relationship (a) between the time interval up to coagulation and the deposition current density was found:

$$t_B = C/j^2 \qquad \text{(a)}$$

where $t_B$ = onset of coating; $C$ = onset-of-coating constant; $j$ = current density in ma/cm.

Thus, the constant C offers essential insight into the throwing power of a binder of a paint system up to coagulation. A comparably simple law may not be found as the film resistance increases past coagulation; however, in this instance, too, there is a functional relationship between the time required to build up a given potential, that is, a given resistance, and the current density. By measuring the time intervals from current application to the point at which, for constant current, the potential suddenly increases on account of the resistance caused by binder coagulation, on the one hand, and by measuring the time interval required by the system to reach a predetermined higher potential, on the other hand, the onset of coating and the rate of build-up of film resistance may be easily computed.

The invention addresses the task of developing a measuring instrument allowing precise measurement of the time intervals between current application and (a) onset of coagulation ($t_B$), (b) build-up of a given film resistance ($R_F$).

The object of the invention is a measuring instrument to determine these parameters, the measuring instrument comprising the following functional blocks:

(a) a current regulating system delivering constant direct current for all output potential up to a maximum of 500 volts, said direct current being adjustable for all values up to 1,200 ma;

(b) a digital current display, digitally accurate to three decimal places;

(c) a digital time display, accurate to 0.1 seconds; and (d) a digital voltage display with an accuracy of 0.1 volts and, associated with it, a network for detecting the time when onset of coagulation is reached and build-up of film resistance commences.

The measuring instrument of the invention uses the fact that, in the case of constant current deposition, the rapid voltage rise caused by an increase in the resistance of the ED-paint bath is an indication of the coagulation point. Furthermore, since the film resistance is always proportional to the potential for constant current, the rate of build-up for a given film resistance may be obtained by measuring the time consumed by the bath in reaching a preselected voltage, higher in value than that at the coagulation point.

Coagulation of an electrodeposition paint does not begin immediately upon applying a current to the deposition bath; rather an acid boundary layer must build up first, that is, the pH value near the anode must drop. When this characteristically low value of pH — which applies to any electro deposition paint — is obtained, the paint will coagulate (because of ceasing to be soluble in the acid phase, and precipitating instead). It was found that the potential remains constant until coagulation and will depend only on the level of the bath resistance if constant direct current is applied to the deposition bath. When the coagulation point is reached, a film resistance formed by a paint film depositing on the anode will be built up. This requires adjusting the potential so that the current will be kept constant. As coating continues, the potential will rise and ultimately cause tearing of the film (rupture potential), so that the coating process must be interrupted, that is, the coated object must be removed from the bath prior to reaching the rupture potential. The potential rise at the onset of coagulation taking place impulsively, this "jump" may be used to determine the coagulation point ($t_1$). The rate of build-up of a film resistance is important because the throwing power depends on the rates of coagulation and film build-up resistance. The faster both are, the better the throwing power is. In practice, as regards coating with paint of automobile bodies, a maximum of 3 minutes is provided.

With the above in mind, the nature of the invention will be more clearly understood by reference to the following detailed description, the appended claimed subject matter, and the several views illustrated in the accompanying drawings, of which:

The design details of the instrument are as follows.

Figure 1:
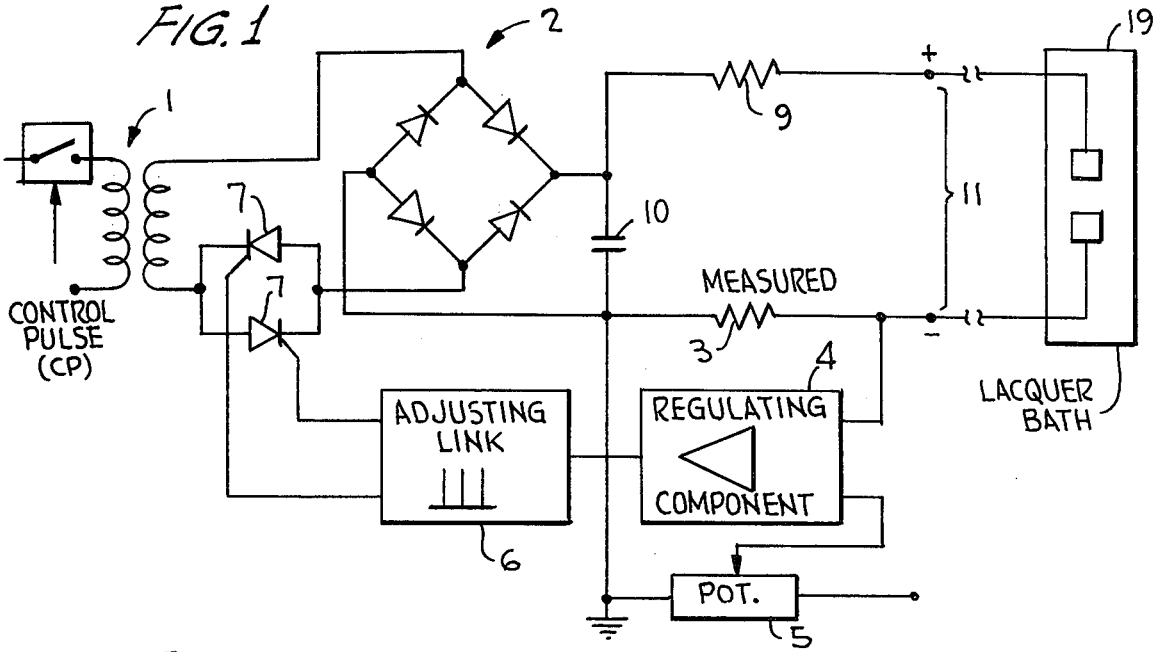
FIG. 1 is a schematic diagram of the current-regulating system.

Current regulation is achieved by the circuit of FIG. 1. AC voltage is applied by a transformer 1 through a current-regulation circuit, shown generally as 2, to a paint bath 19. A potential drop across measured resistance 3 is compared by means of a regulating component 4 with a nominal voltage value provided by a potentiometer 5, deviations from the nominal value being compensated for by adjusting link 6 which controls two thyristors 7. The AC output of the thyristors 7 is rectified by rectifier bridge 8 and is filtered by means of resistor 9 and capacitor 10. Thus, the regulated current output appears at output terminals 11.

Thus, any increase in the resistance of the lacquer bath will cause an increase in the voltage across terminals 11 while current-regulation circuit 2 maintains a constant current output to the lacquer bath.

Figure 2:
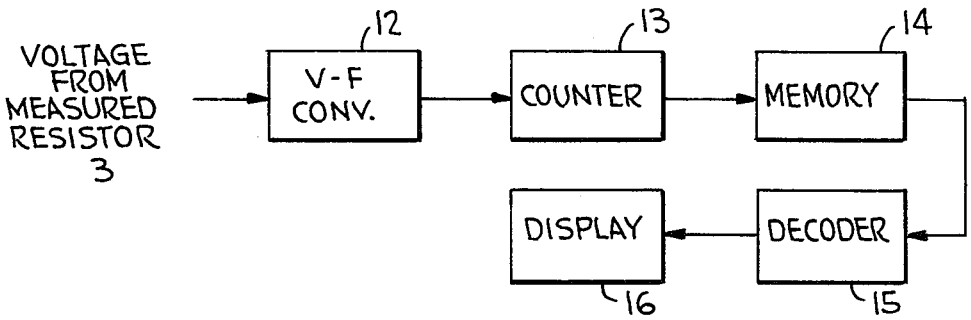
FIG. 2 is a block diagram of a digital current display circuit.

A digital display of the current is achieved by means of the digital current display circuit shown in FIG. 2. The voltage drop across measured resistance 3 is converted by means of a voltage-frequency converter 12 into proportional pulses which are counted, timed and displayed in conventional manner in counter 13, memory 14, decoder 15, and display device 16.

Figure 3:
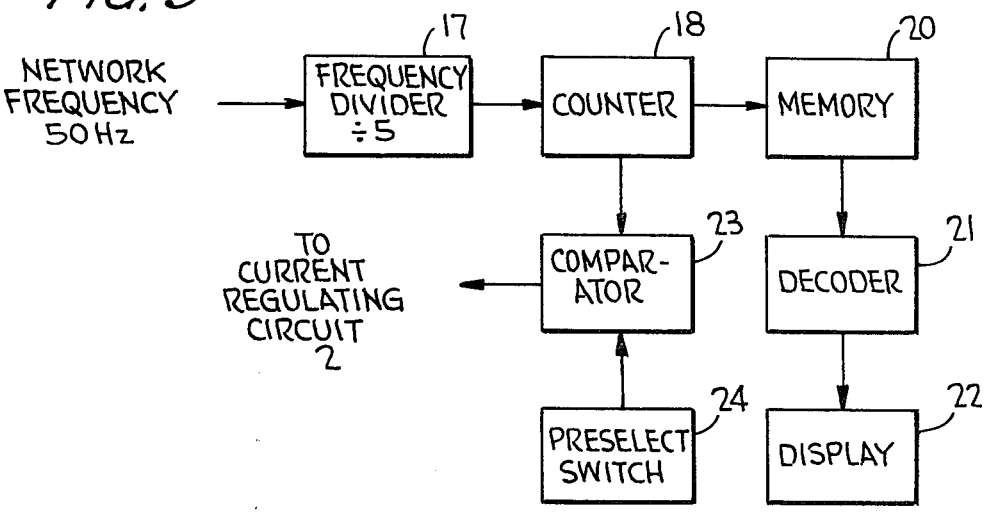
FIG. 3 is a block diagram of a digital time display circuit.

A digital display of time consumption is obtained by means of the digital time display circuit shown in FIG. 3. The time-base for time display is the network frequency of 50 Hz divided by frequency divider 17 down to 10 Hz. These pulses are counted and displayed in conventional manner by counter 18, memory 20, decoder 21, and display 22. A comparator 23 is connected between a number preselection switch 24 and counter 18, and is used to compare a preselected number with the figure instantaneously displayed by the counter stage, the comparator acting to shut off the current regulating system at a preselected time.

It is to be noted that, since two periods are of concern — the time from start of current to onset of coagulation, and the time from start of current to build-up of film resistance — two digital time display circuits, as set forth in FIG. 3, may be used.

Figure 4:
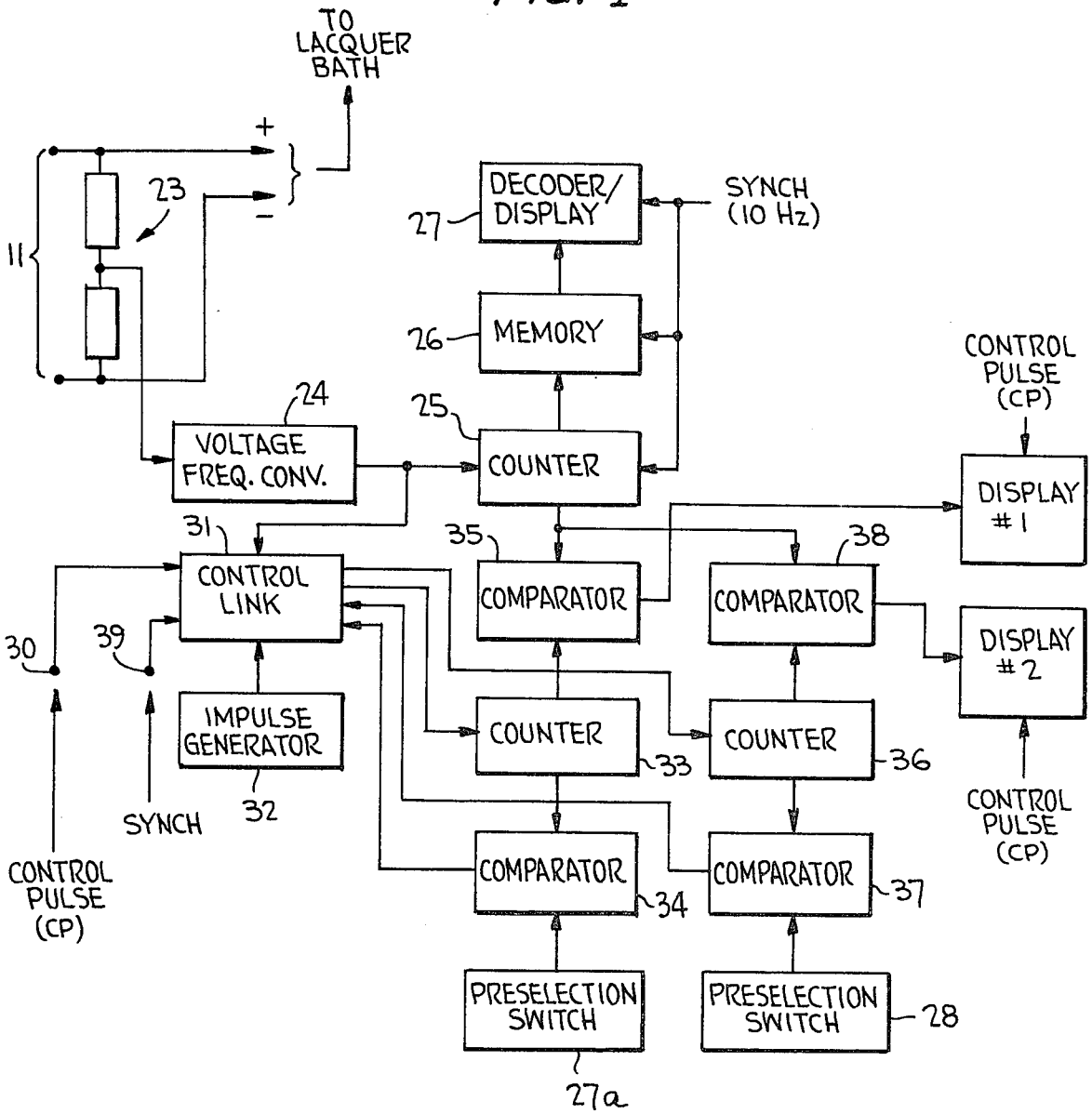
FIG. 4 is a block diagram of a digital voltage display and detection circuit.

A digital display of voltage is achieved by means of the circuit in FIG. 4. As already mentioned, the digital voltage display circuit of FIG. 4 has, associated with it, a network for detecting the onset of coagulation in the paint bath, as well as the achievement of a predetermined voltage across terminals 11 during the period of build-up of film resistance. As a result of this detection, a digital display of the voltage, current and time readings when these two points are reached can be obtained.

A potential divider 23 is connected to the output terminals 11 and divides the output voltage occurring there. Conversion takes place by means of a voltage-frequency converter 24 into proportional pulses which then are counted, synchronized and displayed in counter 25, memory 26, and decoder and display 27. The synchronizing frequency of the latter three stages is 10 Hz and the frequency conversion rate of the voltage-frequency converter is 5 kHz/volt, 500 volts of output potential at the current-regulation circuit corresponding to 10 volts of input potential at the converter. Preselection switches **27*a* and 28** are associated with the voltage display circuit. The function of these switches will be discussed below.

The voltage display circuit operates in principle as follows. A control pulse, which also turns on the constant current-regulation circuit by means known per se, is received at terminal 30 and opens a gate (not shown) in control link 31 between pulse generator 32 (which operates at 1 MHz) and counter 33. This same control pulse also initiates a 500 msec delay period within the control link 31, which delay period will be discussed later. In addition, the same control pulse initiates the digital time display circuits of FIG. 3 so as to initiate two time periods for digital display purposes, that is, a time period up to the onset of coagulation, and the time period during build-up of the film resistance.

Upon the opening of the gate in control link 31 by the control pulse, as mentioned above, the counter 33 counts pulses until its number corresponds to the value set at the preselection switch **27*a*. Preselection switch 27*a* is set at a value such that, when the point of onset of coagulation is reached and the voltage across terminals 11 begins to rise, this phenomenon will be detected by comparator 35 in conjunction with counters 25 and 33**. This will be further discussed below.

When identity is detected by comparator 34, the gate in control link 31 is then closed. The maximum figure which may be set at the preselection switch **27*a* is 5,000 = 500 volts, so that the counting process must terminate no later than after 5 msec. At the end of the 500 msec delay, as set by control link 31, it is assumed that all oscillations in the regulation circuit have decayed, and a gate (not shown) in control link 31 between voltage-frequency converter 24 and counter 33 will be opened. The frequency of converter 24 will be precisely proportional to the potential at output 11. Since the synchronization at counter 25, memory 6 and display 27 is 10 Hz, the pulses will be counted by counter 33 in 100 msec and the contents of that counter will correspond to the potential at output 11**.

Thus, after 600 msec a figure will be stored in counter 33, which figure corresponds to the sum of the potential at output 11 and the value set at the preselection switch **27*a***.

During all this time, the voltage display of the output 11 remains undisturbed at the counter 25, memory 26 and display unit 27. If now, the resistance of the paint bath increases sharply, the voltage across terminals 11 will also increase. The pulse output of voltage-frequency converter 24 to the counter 25 will also increase and the contents of the counter 25 will approach the contents of the counter 33. When the counter 25 reaches the value of the figure stored in counter 33, the comparator 35 will issue a first signal which shut off the display equipment associated with the measurement of the onset of coagulation. Specifically, a display of elapsed time to the onset of coagulation may be obtained from time display No. 1 (as shown in FIG. 4 and as shown in detail in FIG. 3). In addition, a display of the voltage at the onset of coagulation point may be obtained from the voltage display (set forth in detail in FIG. 2).

Measurement of a second time interval during which film resistance is built up in the lacquer can be achieved by a further arrangement according to FIG. 4. Specifically, the control link 31 is connected to a counter 36, the output of counter 36 being connected to comparators 37 and 38. The comparator 37 is connected to preselection switch 28 and, in a manner similar to comparator 34, closes the gate (not shown) in control link 31 when identity is detected. The comparator 38 is connected to receive the outputs of counters 25 and 36, and operates in a manner similar to the operation of comparator 35.

As mentioned previously, once the onset of coagulation point is past, a build-up of film resistance will occur within the paint bath. The increase of resistance therein will result in an increase in the voltage at terminals 11. Thus, the value stored in preselection switch 28 will be chosen such that, when a predetermined value of voltage is reached across terminals 11, counters 25 and 36 will achieve identity and comparator 38 will issue a second signal which will shut off the equipment associated with build-up of film resistance. A display of the elapsed time for build-up of film resistance to a preselected value will remain on time display No. 2 (as shown in FIG. 4 and as shown in detail in FIG. 3). In addition, a display of the voltage at the selected film resistance build-up point may be obtained from the voltage display (set forth in detail in FIG. 2).

Measurement of the two time intervals practically is so carried out that, by connecting the electrodes of the ED basin to the output of the potential preselection switches unit, one potential each is preselected which, when added to the voltage drop per equation (b) in the deposition circuit and also in the lines, is followed by the display of the particular elapsed time.

$$U_A = JR_{B+Z} + U_{VW} \qquad \text{(b)}$$

where $U_A$ = display potential (= potential at which time is displayed); $J$ = deposition current; $R_{B+Z}$ = bath and line resistance; $U_{VW}$ = potential set at preselector.

The advantage of the circuit is that the same film resistance always can be determined regardless of the bath resistance which may vary widely for the various ED paints and regardless of the basin geometry, and that additionally the decisive value for the throwing power, to wit, the rate of a given film resistance build-up, may be immediately determined from the time displayed.

The following examples will elucidate the method of measurement and computation:

EXAMPLE 1

GIVEN BATH DATA bath and line resistance $R_{B+Z} = 10$
deposition current $J = 800$ ma
$U_{B+Z} = 8$ volts
anode surface = 200 cm$^2$
current density = 4 ma/cm$^2$ PRESELECTED POTENTIALS (internally compensated):

$U_K$ for coagulation onset −2 volts (i.e., 10 volts effective)
$U_A$ for film resistance = 150 volts (i.e., 158 volts effective)

TIME MEASURED (in seconds):

$t_B$ (coagulation onset) = 10
$t_A$ (film resistance) = 50

COMPUTATION:

1. coating onset constant per eq. (a):

$$10 \times 4^2 = 160$$

2. build-up rate (b) for film resistance film resistance $R_F$=(158–8)/0.8 = 187.5 ohms $B = R_F/t$ = 3.75 ohm/sec

EXAMPLE 2

GIVEN BATH DATA:

$R_{B+Z} = 20$
$J = 800$ ma
$U_{B+Z} = 16$ volts
anode surface = 200 cm$^2$
current density = 4 ma/cm$^2$

PRESELECTED POTENTIALS:

$U_K = 2$ volts (= 18 volts)
$U_A = 150$ volts (= 166 volts)

MEASURED TIME (in seconds):

$t_B = 8.5$
$t_A = 40$

COMPUTATION:

$C = 8.5 \times 4^2 = 136$
$R_F = (166 - 16)/0.8 = 187.5$ ohms
$B = 4.69$ ohm/sec While preferred forms and arrangements of parts have been shown in illustrating the invention, it is to be clearly understood that various changes in detail and arrangement of parts may be made without departing from the spirit and scope of this disclosure.

I claim:

1. In an electrodeposition bath system including a bath of paint, anode and a cathode electrodes in said bath, and a constant current generating means for maintaining an essentially constant current between said electrodes, the combination of:

sensing means for sensing an increase in the voltage drop between said electrodes;

first time indicating means for recording elapsed time from the initiation of said constant current;

second time indicating means for recording elapsed time from the initiation of said constant current;

first detecting means connected to said sensing means and to said first time indicating means for causing said first time indicating means to record that elapsed time which represents the onset of a sharp rise of voltage drop between said electrodes; and second detecting means connected to said sensing means and to said second time indicating means for causing said second time indicating means to record that elapsed time which represents attainment of a selected voltage drop between said electrodes which occurs subsequent to the onset of said sharp rise.

2. In an electrodeposition bath system as recited in claim 1 wherein said sensing means includes voltage to frequency converter means.

3. In an electrodeposition bath system as recited in claim 1 wherein said first detecting means includes:

counting means connected to said sensing means for developing a count which indicates the voltage drop between said electrodes;

reference means for providing a reference count which indicates the onset of a sharp rise of voltage drop between said electrodes; and comparator means connected to said counter means and said reference means for detecting identity between the values stored therein, and connected to said first time indicating means for causing said first time indicating means to record that elapsed time which represents the onset of a sharp rise of voltage drop between said electrodes in response to said identity.

4. In an electrodeposition bath system as recited in claim 1 wherein said second detecting means includes:

counting means connected to said sensing means for developing a count which indicates the voltage drop between said electrodes;

reference means for providing a reference count which indicates a preselected voltage drop between said electrodes; and comparator means connected to said counter means and said reference means for detecting identity between the values stored therein, and connected to said second time indicating means for causing said second time indicating means to record that elapsed time which represents attainment of a selected voltage drop between said electrodes subsequent to the onset of said sharp rise.

5. In an electrodeposition bath system as recited in claim 1 including a control means connected between said constant current generating means and each of said first and second time indicating means for providing a control pulse thereto which indicates the initiation of said constant current.

6. A measuring system to determine the throwing power parameters of electro-immersion lacquers which are the time intervals between turning on the power and the synthesizing of the film-resistance predetermined by the pre-selected potential, comprising, constructed and arranged in cooperating relation, two electrodes mounted in an electro-immersion bath and connected to a DC source; a measuring instrument for determining electrode potential; a comparison circuitry for the measured electrode potential comprising two potentials exceeding that applied prior to onset of coagulation by adjustable values, and by a timing arrangement for the time lapsed between turning on of the power and reaching the two aforesaid potentials.

7. Measuring system as defined in claim 6 including a rectifier bridge in the DC source in series with two antiparallel thyristors on the AC side and furthermore in series on the DC side with a filtering circuit consisting of a resistance and a capacitance and with a measurement resistance acting as an actual value source and in that the potentials are fed from a resistor and from a potentiometer acting as a reference on the other to a differential amplifier which is followed by an adjusting component for said thyristors.

8. Measuring system as defined in claim 6 wherein the measuring device for the electrode potential includes a voltage-frequency converter and a digital display.

9. Measuring system as defined by claim 6 wherein the comparison circuitry with said two potentials exceeding that applied prior to onset of coagulation by adjustable values comprises a pulse generator with a subsequent control stage consisting of two monostable flip-flops and gate-circuits to which are connected two digital counting units and two comparison units, said latter units being connected with pre-selection switches and with digital counting units which in turn are connected again with comparison units which in turn are connected with a digital counting unit.

10. Measuring system as defined in claim 6 wherein the time-lapse measuring device to measure the time from turning on the power to reaching the two aforesaid potentials is connected by means of control outputs with comparison units and consists of two decade counters with subsequent digital displays.

* * * * *